US009359768B2

(12) United States Patent
Svirsky

(10) Patent No.: US 9,359,768 B2
(45) Date of Patent: Jun. 7, 2016

(54) ADJUSTABLE ALL-SEASON WINDOW AWNING/LIGHT SHELF AND OPERATING MECHANISM THEREFOR

(71) Applicant: Alexander Svirsky, Aurora, CO (US)

(72) Inventor: Alexander Svirsky, Aurora, CO (US)

( * ) Notice: Subject to any disclaimer, the term of this patent is extended or adjusted under 35 U.S.C. 154(b) by 340 days.

(21) Appl. No.: 13/924,617

(22) Filed: Jun. 24, 2013

(65) Prior Publication Data

US 2013/0284381 A1 Oct. 31, 2013

Related U.S. Application Data

(62) Division of application No. 13/007,980, filed on Jan. 17, 2011, now abandoned.

(51) Int. Cl.
*E04F 10/00* (2006.01)
*E06B 9/24* (2006.01)

(52) U.S. Cl.
CPC ..... *E04F 10/005* (2013.01); *E06B 2009/2417* (2013.01)

(58) Field of Classification Search
CPC ..... E04F 10/00; E04F 10/0614; E04F 10/005; E06B 3/5009; E06B 3/509; E06B 3/5054; E06B 3/50; E06B 2009/2417
USPC ..... 160/22, 172 R, 203, 205, 208, 81, 82, 160/62, 49; 49/360, 61, 71, 158, 188, 189, 49/190, 191, 260, 146, 252, 149, 152–157
See application file for complete search history.

(56) References Cited

U.S. PATENT DOCUMENTS

| | | | | |
|---|---|---|---|---|
| 2,709,582 | A * | 5/1955 | Chapman | 49/81.1 |
| 5,381,738 | A * | 1/1995 | Meyer | 108/42 |
| 5,980,052 | A * | 11/1999 | Thor et al. | 359/877 |
| 8,027,092 | B1 * | 9/2011 | Huff et al. | 359/591 |
| 2009/0032100 | A1 * | 2/2009 | Oak | 136/259 |
| 2013/0248124 | A1 * | 9/2013 | Barbulescu | 160/59 |
| 2013/0301134 | A1 * | 11/2013 | Yokota | 359/591 |

* cited by examiner

*Primary Examiner* — Syed A Islam
*Assistant Examiner* — Jeremy Ramsey
(74) *Attorney, Agent, or Firm* — Alexander R. Svirsky

(57) ABSTRACT

An adjustable window awning/light shelf includes a canopy attached to supports on both sides of the window. The supports are engaged with vertical drive screws providing for the possibility of moving the canopy up and down. Each drive screw is connected with a common drive shaft. During the cooling season, the canopy is disposed at the top of the window, shading the window from the sun. During the heating season, the canopy is brought down to the bottom of the window by rotating the drive shaft, which in turn rotates the drive screws and moves the supports with the canopy down. Canopy's angle relative to the window increases. When in the bottom position, the awning performs as a light shelf, reflecting sunlight into the window and increasing the amount of sunlight and solar heat entering the building through the window.

6 Claims, 10 Drawing Sheets

ADJUSTABLE ALL-SEASON WINDOW AWNING/LIGHT SHELF AND OPERATING MECHANISM THEREFOR

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention relates to window awnings and more particularly to adjustable window awnings.

Window awnings are used to protect buildings, including building interiors, from excessive gain of solar heat through windows, and also as architectural elements to enhance aesthetic appeal of building exteriors. Shading windows with awnings is one of the most popular methods of increasing energy efficiency of buildings. By lowering temperature inside the building during the air conditioning season, awnings create savings in cooling energy. According to a 2007 study by the University of Minnesota entitled "Awnings in Residential Buildings," awnings may reduce consumption of cooling energy by up to 69% and peak electricity demand by up to 49%, depending on the building location and some other factors.

During the heating season, however, window awnings may block desirable passive gain of solar heat, offsetting energy savings achieved during the cooling season. Therefore, to achieve the highest energy savings, it is advisable to remove or retract window awnings during the period when the building needs to be heated. Because removing awnings for the heating season is inconvenient and could be expensive, it is preferable to use awnings that may be retracted or adjusted to allow desirable solar heat to reach the building interior through windows.

Such retractable or adjustable window awnings are well known in the industry and usually are made of fabric. A retractable fabric awning is retracted by rolling the fabric up onto a roller rotatably attached to the building. Even though retractable fabric awnings have been in use for decades, they are not sufficiently durable and require periodic replacement of the fabric. Fabric colors are prone to fading, reducing the aesthetic appeal of such awnings.

Also known are retractable or adjustable rigid awnings. An example of such adjustable awnings is described in U.S. Pat. No. 2,791,009 to Wagner. It is a louver type awning where louvers are operated by a link mechanism. Among the disadvantages of such awning is the existence of an excessive number of movable parts subject to weather elements, which makes it prone to malfunction. Also, such awning cannot be retracted for the heating season and therefore inevitably creates shade when it is not needed. A collapsible rigid awning is described in U.S. Pat. No. 6,202,363 to Chang. It may be collapsed when shade is not required, however its operating mechanism is complicated, consisting of many movable parts subject to weather elements, and also is prone to malfunction. In addition, when in the collapsed position, such awning requires substantial additional side space approximately equal to the length of its panels. Another type of retractable rigid awnings is available on the market in the form of roll-up awnings. Such awning consists of narrow aluminum strips connected to each other with ropes or bands and is retracted by rolling these strips up onto a roller, similarly to retractable fabric awnings. This design does not allow for any side panels that may be desired, has many small movable parts and requires constant tension to be applied to the connecting ropes or bands to maintain the awning in a taut condition, which reduces the awning's durability. An adjustable sunshade is described in U.S. Pat. No. 6,421,966 to Braunstein, et al. The sunshade is adjustable only at the time of its installation and creates shade during the heating season, thereby reducing energy savings obtained during the cooling season.

All of the above mentioned known retractable or adjustable window awnings provide no energy savings benefit during the heating season. Even when retracted or adjusted to prevent or reduce undesirable shading, they continue to age and deteriorate without providing any benefits.

An awning design that aims at providing an opportunity to use the awning as both a shading device and a sunrays reflection device that would aid in heating the interior of the building is described in U.S. Pat. No. 4,309,981 to Briggs, et al. In this design, the procedure to switch the awning function from shading to heating is cumbersome and requires direct access to the awning's canopy from the outside, but adjustment of the canopy's angle of inclination, on the contrary, may only be made from the inside of the building, which requires serious modifications of an existing window. Another embodiment of the same invention also allows canopy adjustment to be performed only from the inside requiring extensive modifications of an existing window.

Another combination window awning and solar heat unit is provided in U.S. Pat. No. 4,043,316 to Arent. In this combination unit, the lower part of the window is continually closed during the hot season, reducing the amount of daylight entering the building. The awning may be adjusted only by direct manual access from the outside. During the cold season, snow and ice will accumulate behind the upper awning panel when it is rotated up into its heating position. Neither of these last two inventions allows for the entire process of changing the awning function between shading and heating to be motorized.

BRIEF SUMMARY OF THE INVENTION

The present invention provides an adjustable window awning that also may be used as a light shelf. The awning includes a canopy attached to support elements on both sides of the window. The support elements are threaded and engaged with vertical drive screws providing for the possibility of moving the support elements with the canopy up and down relative to the window. Each drive screw is connected via a transmission gear with a common drive shaft. During the cooling season, when the window needs to be shaded, the canopy is disposed at the top of the window. When shade is not required, the canopy is brought down to the bottom of the window by rotating the drive shaft, which in turn rotates the drive screws and moves the support elements with the canopy down. The top surface of the canopy is made reflective, which increases the amount of sunlight and associated solar heat entering the building through the window by reflecting additional sunlight into the window when the awning is in its bottom or intermediate position and performs as a light shelf.

Such reflective surface also provides benefits during the hot season when the awning is in its top position. It reflects sunlight from the awning to keep the air between the awning and the window at a lower temperature.

An object of the present invention is to provide a simple, convenient and durable adjustable window awning that would reduce gain of solar heat through the window during the cooling season and may be moved out of the way and permit access of desirable solar heat into the building during the heating season.

Another object of the present invention is to provide an adjustable window awning that would increase gain of solar heat through the window during the heating season to provide additional energy savings.

A further object of the present invention is to provide an adjustable window awning that may be used as a light shelf.

A further object of the present invention is to provide an adjustable window awning that may be adjusted to shade a portion of the window, while allowing desired sunlight to enter the building through the window above and under the awning.

A further object of the present invention is to provide an adjustable window awning that may be easily operated either from the inside or from the outside of the building.

A further object of the present invention is to provide an adjustable window awning that may be easily operated manually or by power.

BRIEF DESCRIPTION OF THE DRAWINGS

Other advantages of the present invention will be apparent to those skilled in the art from the following description of its embodiments with reference to the accompanying drawings wherein.

DETAILED DESCRIPTION OF THE INVENTION

Figure 1:
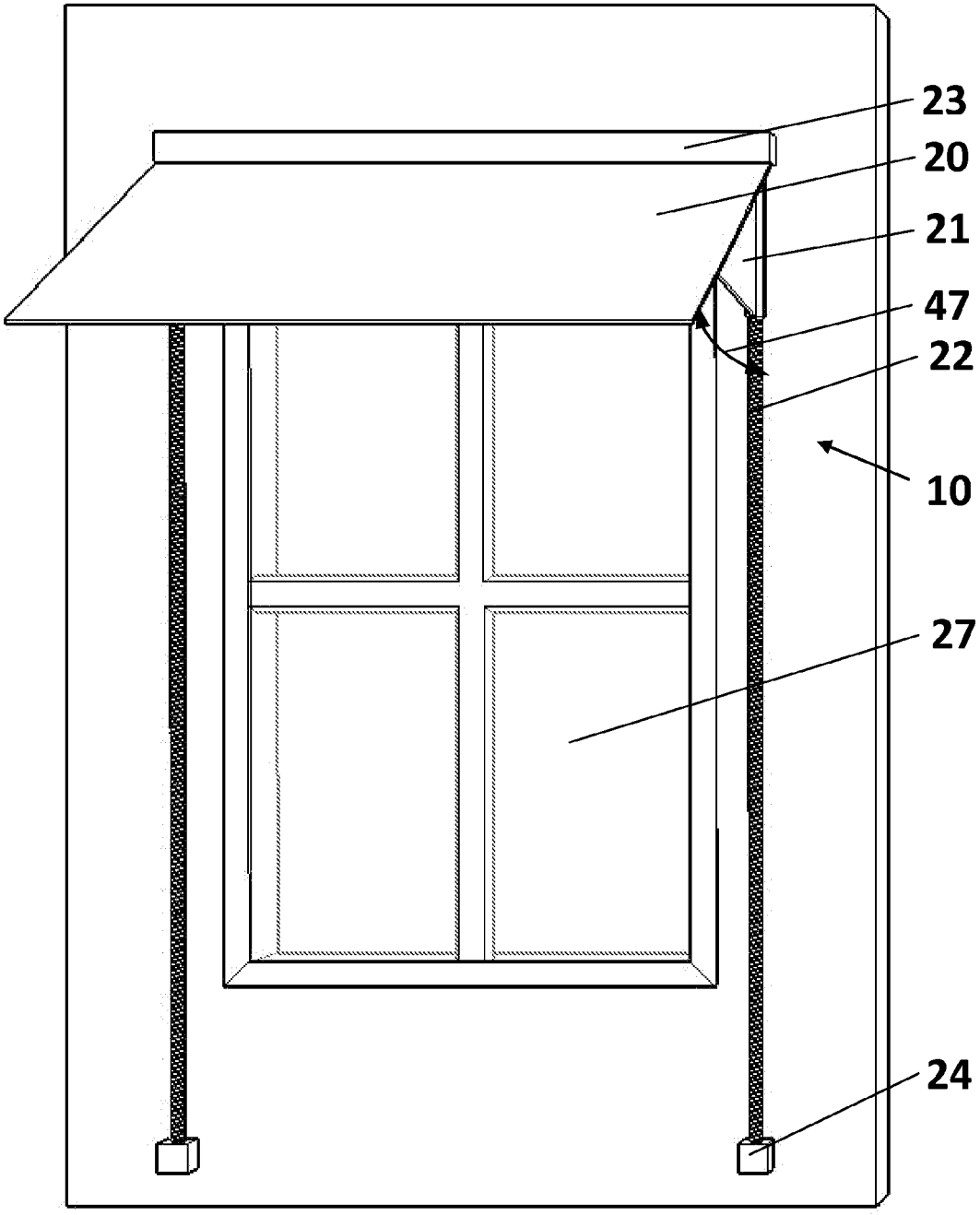
FIG. 1 is an isometric view of an adjustable window awning in its top position.
Figure 2:
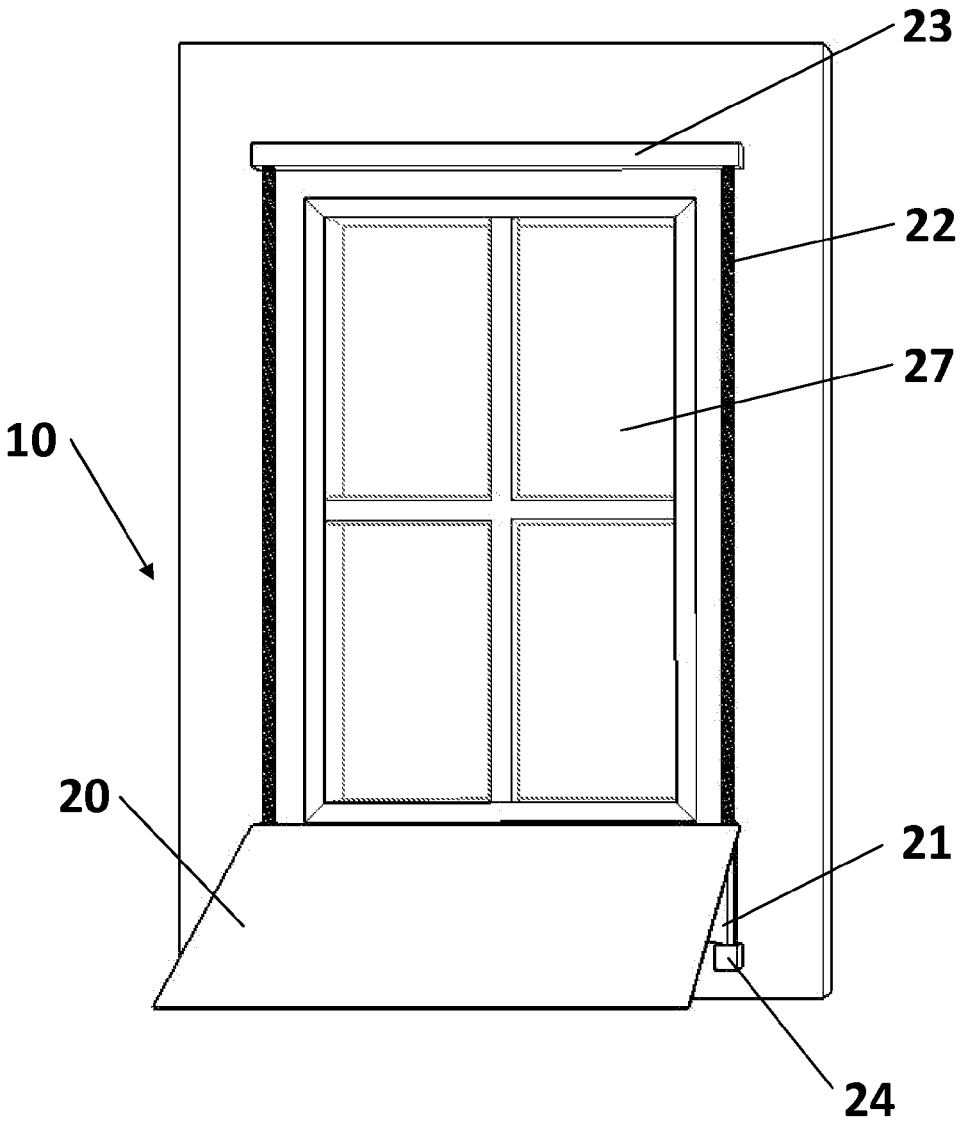
FIG. 2 is an isometric view of the adjustable window awning in its bottom position.

Referring to the drawings, in particular to FIGS. 1 and 2, where an adjustable window awning is generally designated by a numeral 10, the awning includes a canopy 20 supported by fixed support elements 21. The support elements 21 are engaged with drive screws 22 connected with a housing 23 at the top and with bottom supports 24.

Figure 3:
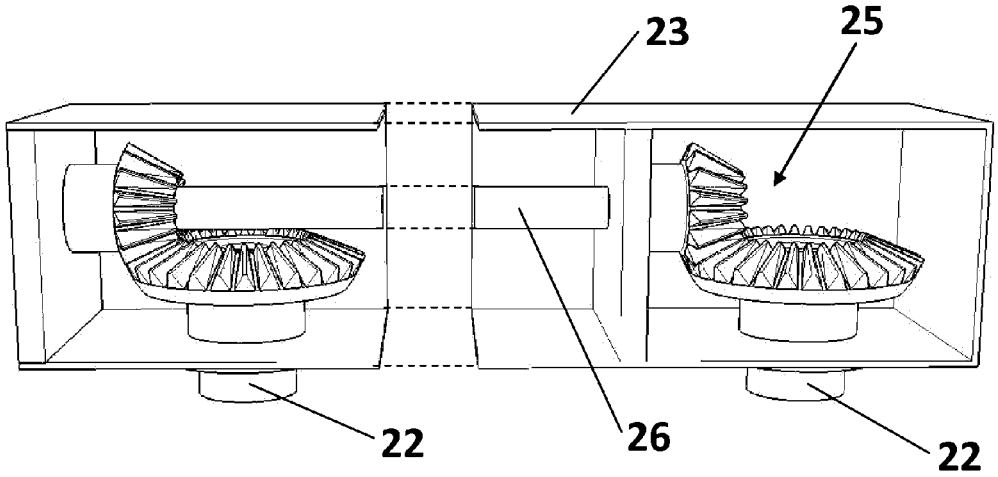
FIG. 3 is an isometric view of an operating mechanism of the awning of the present invention with the front panel removed.

As shown in FIG. 3, each drive screw 22 is connected via a transmission gear 25 with a drive shaft 26.

To lower the canopy 20 from its top position depicted in FIG. 1 to its bottom position depicted in FIG. 2, the drive shaft 26 is rotated by using a manual drive gear or an electric motor (not shown). Rotation of the drive shaft 26 causes the drive screws 22 to rotate simultaneously and move down the support elements 21 along with the canopy 20.

Figure 4:
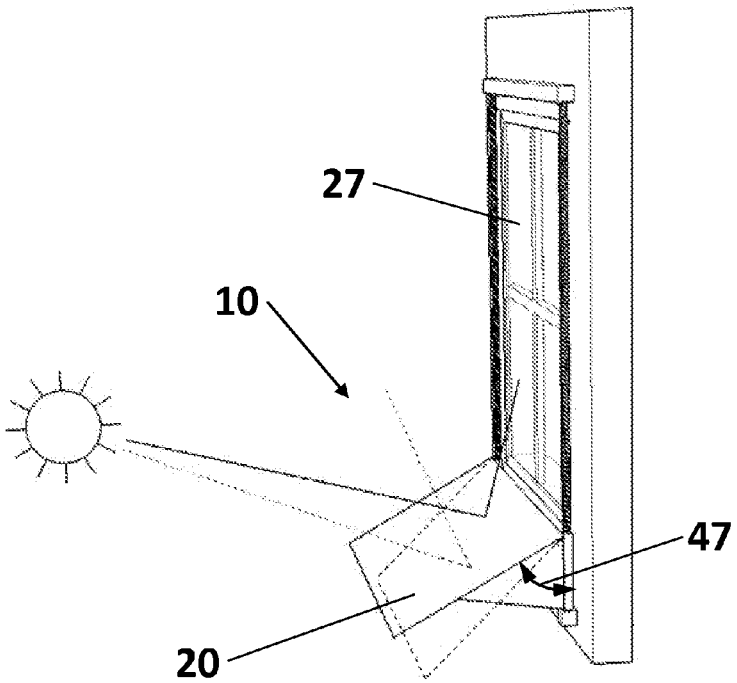
FIG. 4 is a schematic of sunrays reflecting from the inclined top surface of the awning's canopy.

FIG. 4 shows sunrays reflecting from the canopy 20 into a window, when the canopy is in its bottom position, thereby increasing the amount of sunlight and solar heat entering the building through the window.

Figure 5:
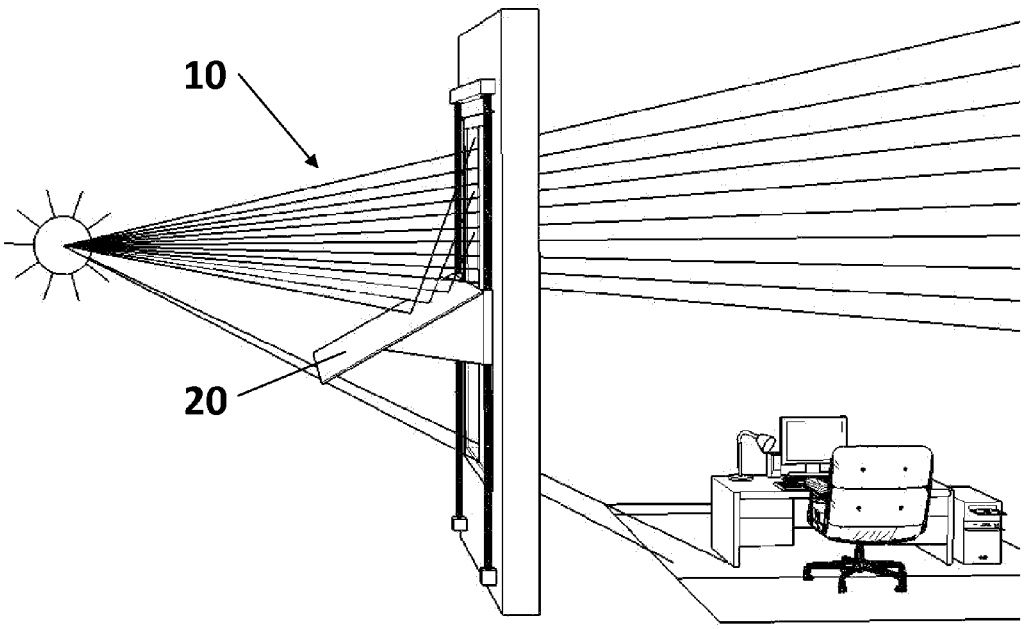
FIG. 5 is a view of the awning stopped in an intermediate position to block undesirable sunrays from a workstation.

FIG. 5 shows the awning, which may be stopped in any intermediate position between its top and bottom positions, adjusted so that it blocks undesirable sunrays from a workstation while allowing desirable sunlight to enter the room through the window above and under the canopy 20. At the same time, sunrays blocked by the awning reflect from the canopy's top surface into the window and partially compensate for the amount of daylight blocked by the awning.

In order for the awning to be effective both as a shading device during the cooling season and a sunlight reflective device, or light shelf, during the heating season, its canopy 20 should be inclined at a relatively large angle 47, for example 60 degrees, to the window plane 27, as shown in FIGS. 1 and 2, and also in FIG. 4 in solid lines. Otherwise, if the canopy is inclined at a lesser angle, for example 45 degrees, sunrays will not reflect into the window when the awning is in its bottom position, and will instead reflect into the empty space in front of the window, as shown in FIG. 4 in dashed lines.

Figure 11:
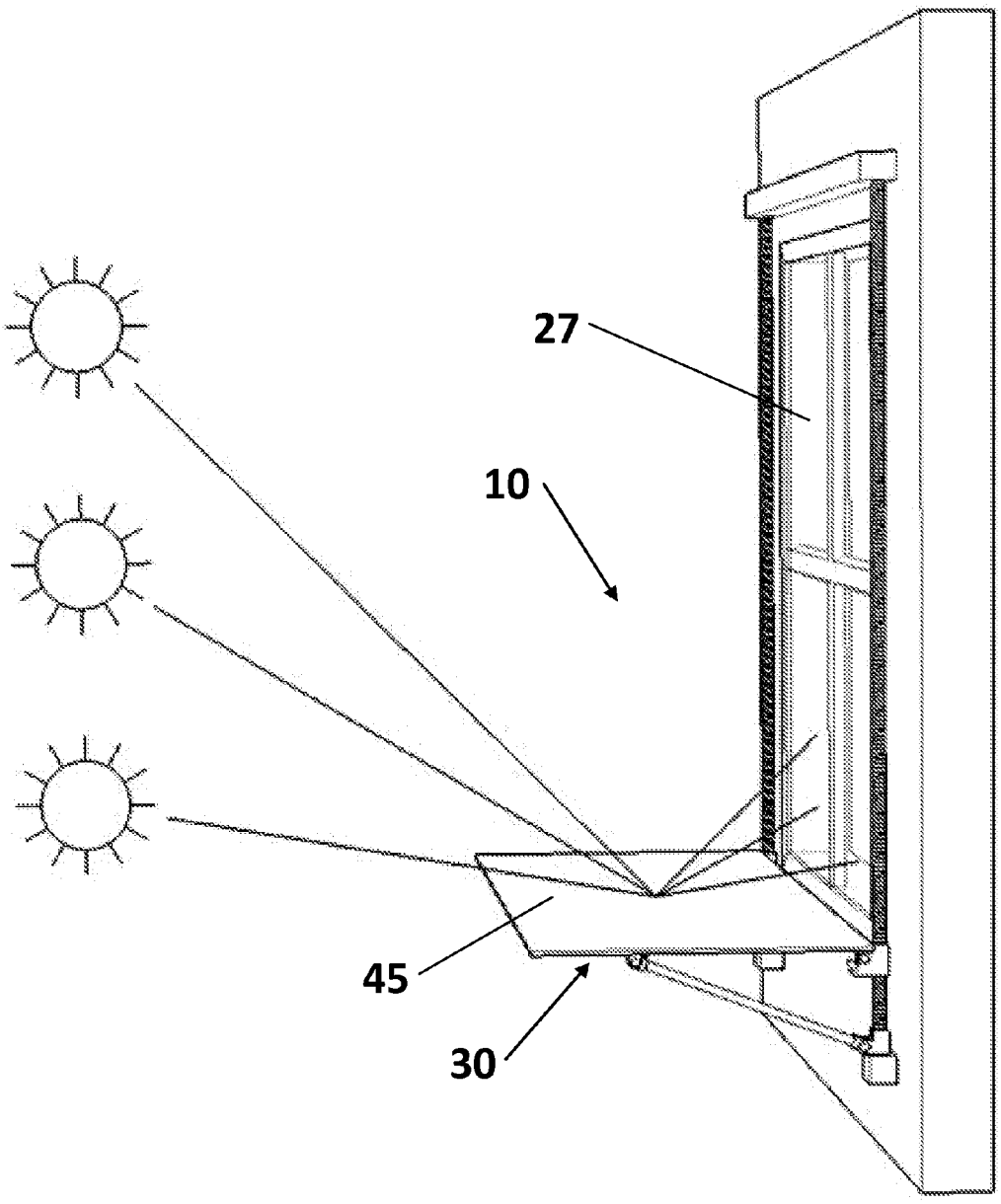
FIG. 11 is schematic of sunrays reflecting from the top surface of the awning's canopy into the window when the awning is in the final bottom position and performs as a light shelf.

However, the awning would be more effective in its top position, as a shading device, if inclined at a lesser angle, for example 45 degrees, and more effective it its bottom position, as a sunlight reflective device, if inclined at a greater angle, ideally 90 degrees, to the window plane 27. Such perpendicular position would ensure the reflection of sunrays from the canopy's top surface 45 into the window regardless of the sun's angle above the horizon, as shown in FIG. 11. The awning would perform as an exterior light shelf increasing desirable solar heat gain and providing additional daylight during the cold season. In practice, the angle of awning inclination would be slightly less than 90 degrees, to provide for water drainage.

FIGS. 6-11 show the awning of the present invention where the angle 47 of the awning canopy 30 inclination relative to the window plane 27, i.e. the angle between the canopy's bottom surface 46 and the window plane, changes from approximately 45 degrees in the top position to approximately 90 degrees in the bottom position.

The awning includes a canopy 30 supported by support arms 31. Bottom ends of the support arms 31 are hinged to bottom sliders 32 engaged with drive screws 33. Top ends of the support arms 31 are hinged to bottom canopy brackets 34 affixed to the canopy 30. Top canopy brackets 35 are affixed to the canopy 30 and hinged to top sliders 36 engaged with the drive screws 33.

Figure 6:
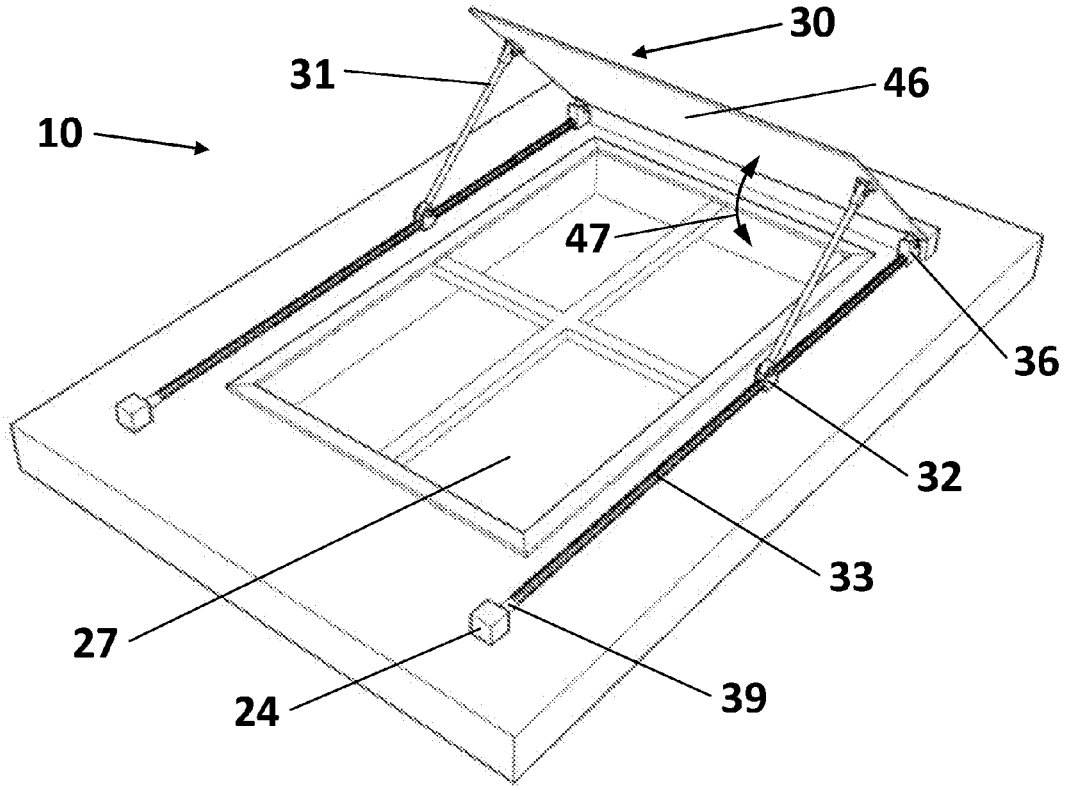
FIG. 6 is an isometric view of an adjustable window awning constructed in accordance with the present invention in its top position.
Figure 8:
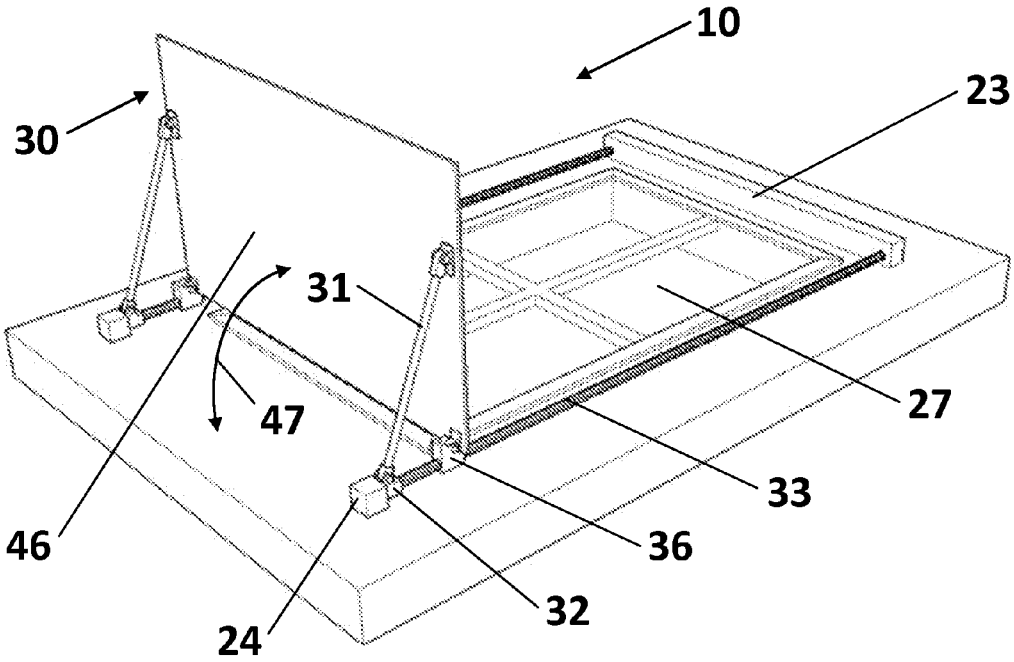
FIG. 8 is a view of the awning shown in FIG. 6 in the final bottom position.

To lower the canopy 30 from its top position depicted in FIG. 6 to its bottom position depicted in FIG. 8, the drive shaft 26 is rotated by using a manual drive gear or an electric motor (not shown). Rotation of the drive shaft 26 causes the drive screws 33 to rotate simultaneously and move down the sliders 32 and 36 along with the support arms 31 and canopy 30.

Figure 7:
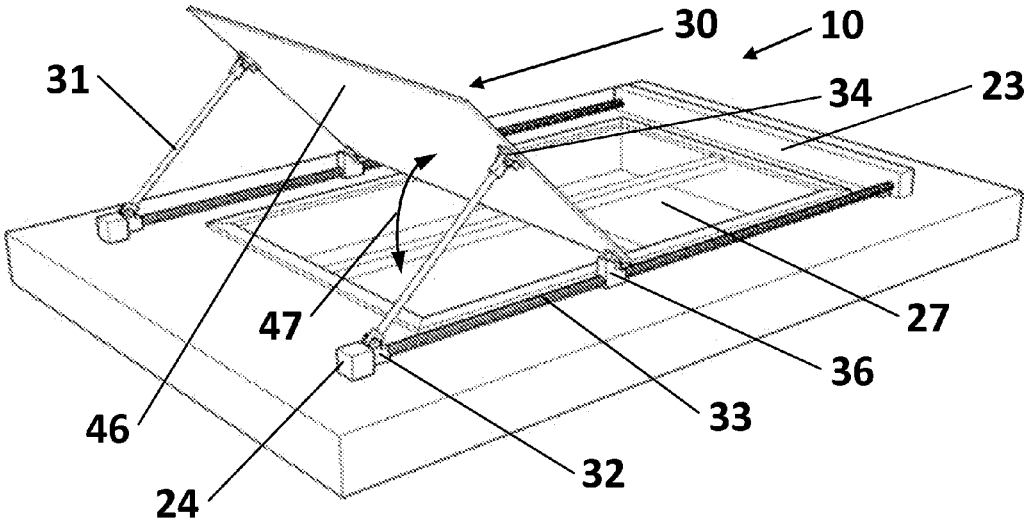
FIG. 7 is a view of the awning shown in FIG. 6 in the intermediate bottom position.
Figure 10:
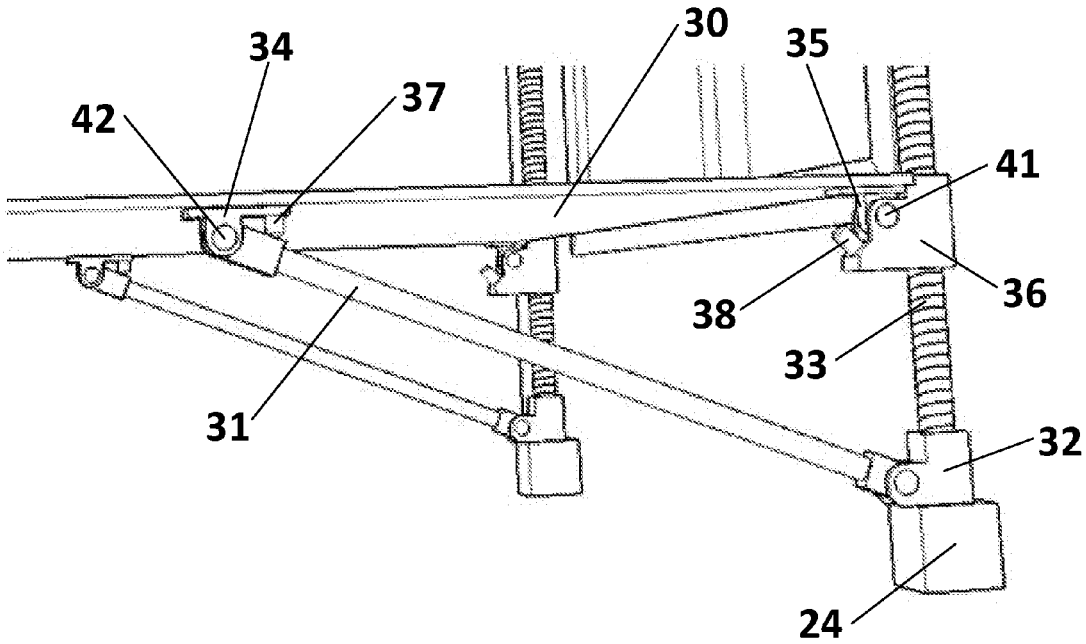
FIG. 10 is an enlarged view of both top and bottom sliders, top and bottom panel brackets and a support arm when the awning is in the position shown in FIG. 8.

Bottom sections 39 of the drive screws 33 are unthreaded, as shown in FIG. 6, over a length not less than the length of threads inside the bottom sliders 32. When the bottom sliders 32 reach the bottom supports 24, the bottom sliders disengage from the threads of the drive screws 33. FIG. 7 shows the intermediate bottom position of the awning when the bottom sliders 32 have reached the bottom supports 24 and are disengaged from the threads of the drive screws 33. Continued rotation of the drive screws 33 causes the top sliders 36 to continue their movement down the drive screws 33 while the bottom sliders 32 remain stationary. The canopy 30 rotates around top pivots 41 installed in the top sliders 36 and bottom pivots 42 installed in the bottom canopy brackets 34. The angle 47 between the canopy's bottom surface 46 and the window plane 27 increases. Such downward movement of the top sliders 36 may continue until downward movement stops 37 attached to the bottom canopy brackets 34 reach the surface of the support arms 31 as shown in FIG. 10. At this point, the canopy 30 is disposed at an angle of approximately 90 degrees to the window plane 27 as shown in FIG. 8. It would be advisable to make the bottom sliders 32 spring-loaded relative to support arms 31 or fix the bottom sliders in this position with releasable locks (not shown) to prevent their movement under the influence of wind on the canopy 30. Such spring-loading and locks are well known in the industry.

Figure 9:
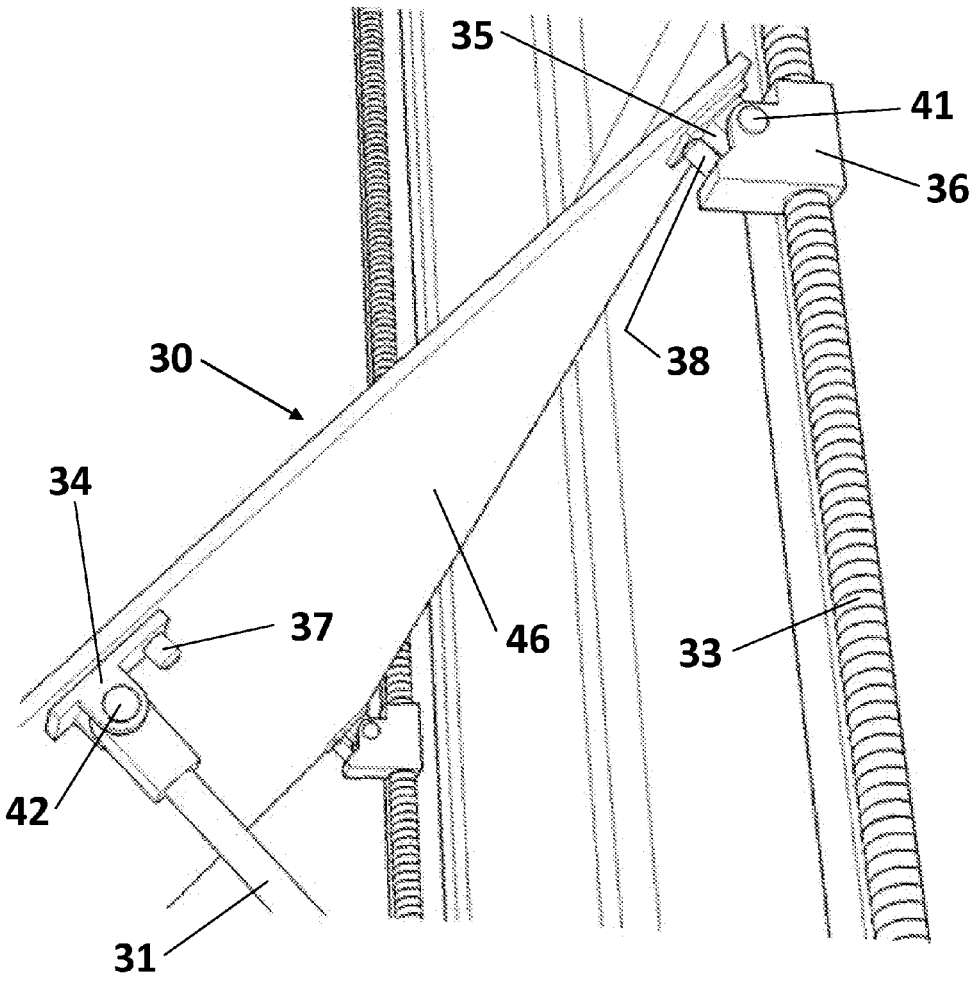
FIG. 9 is an enlarged view of a top slider hinged to a top panel bracket and a support arm hinged to a bottom panel bracket when the awning in the position shown in FIG. 7.

To raise the canopy 30 from its final bottom position depicted in FIG. 8 to its top position depicted in FIG. 6, the drive shaft 26 is rotated in the opposite direction. Such rotation causes the top sliders 36 to move up the drive screws 33 pushing the top canopy brackets 35. This causes the canopy 30 to rotate around the top pivots 41 and bottom pivots 42. The bottom sliders 32 remain stationary until upward movement stops 38 attached to the top sliders 36 reach the surface of the top canopy brackets 35 as shown in FIG. 9.

At this point, the rotation of the canopy 30 around the pivots 41 and 42 stops and the canopy continues to move up toward the housing 23, retaining its angle of inclination relative to the window plane 27 and pulling the support arms 31, which, in turn, pull up the bottom sliders 32. The bottom sliders 32 reengage with the threads of the drive screws 33 and both top and bottom sliders, the canopy 30 and the support arms 31 continue moving up. This movement may continue until the canopy 30 reaches the housing 23.

It will be understood that this invention is not restricted to the design described and illustrated above. A different mechanism may be employed to move the canopy between its top and bottom positions, for example a mechanism located at the bottom of the drive screws 22 or 33 or a mechanism employing a different method of moving the canopy between its top and bottom positions, such as a sliding motion mechanism as opposed to a screw drive. The bottom sliders 32 may be unthreaded and perform a sliding motion along the drive screws 33. Stopping the canopy at the desired angle of inclination may be accomplished in a variety of different methods known in the industry. The drive shaft 26 may be rotated manually, either from the outside or from the inside of the building, by using simple transfer mechanisms well known in the industry. The drive shaft 26 may be rotated by using a remotely controlled electric motor, also well known in the industry, which may be powered by solar panels. The stops 37 and 38 may be replaced with other devices known in the industry that would stop the canopy in its desired position during its respective downward and upward movements. The canopy may have a concave top surface shaped to maximize sunlight reflection into the window. The drive screws 22 and 33 may be screened with enclosures for aesthetic purposes. Any such modifications will remain within the scope of the present invention.

The invention claimed is:

1. An adjustable window awning and light shelf comprising:

a canopy positioned in front of a window at a certain angle relative to said window;

an operating mechanism to move said canopy between its awning position near the top of said window and its light shelf position near the bottom of said window, said operating mechanism comprising means to maintain said angle during the initial stage of moving said canopy from its awning position into its light shelf position and to increase said angle during the concluding stage of moving said canopy from its awning position into its light shelf position and, conversely, to decrease said angle during the initial stage of moving said canopy from its light shelf position into its awning position and to maintain said angle during the concluding stage of moving said canopy from its light shelf position into its awning position.

2. An adjustable window awning and light shelf of claim 1 wherein said canopy comprises top brackets and bottom brackets affixed to said canopy, support arms, top ends of said support arms being attached to said bottom brackets; and said operating mechanism comprises top sliders, said top brackets being attached to said top sliders, bottom sliders, bottom ends of said support arms being attached to said bottom sliders, vertical guides extending from top to bottom of said window and means to move said top and bottom sliders along said vertical guides.

3. An adjustable window awning and light shelf of claim 2, wherein said vertical guides are drive screws, said top and bottom sliders are engaged with said drive screws, each of said drive screws is connected via a transmission gear with a common drive shaft, whereby rotating said drive shaft causes said drive screws to rotate and move said top and bottom sliders along said drive screws.

4. An adjustable window awning and light shelf of claim 3, wherein said top ends of said support arms are hinged to said bottom brackets, said top brackets are hinged to said top sliders, said bottom ends of said support arms are hinged to said bottom sliders, said drive screws are connected with said drive shaft at their top ends and supported by bottom supports at their bottom ends, whereby rotating said drive shaft causes said drive screws to rotate and move said top and bottom sliders down, said bottom sliders to stop upon reaching said bottom supports and said top sliders to continue their downward movement, which causes said canopy to rotate and increase said angle to assume a light shelf position, and rotating said drive shaft in the opposite direction causes said top sliders to move up, said canopy to rotate and decrease said angle, said bottom sliders to follow said top sliders, said top and bottom sliders to move upward and said canopy to assume an awning position.

5. An adjustable window awning and light shelf of claim 4, wherein said top and bottom sliders are threaded, said drive screws have bottom sections adjacent to said bottom supports unthreaded, whereby said bottom sliders disengage from said drive screws upon reaching said bottom sections on their way down and reengage with said drive screws on their way up.

6. An adjustable window awning and light shelf of claim 4, wherein said operating mechanism additionally comprises:

downward movement stops limiting canopy rotation during its downward movement into a light shelf position;

upward movement stops limiting canopy rotation during its upward movement into an awning position.

* * * * *